US009604471B2

(12) United States Patent
Liu

(10) Patent No.: US 9,604,471 B2
(45) Date of Patent: Mar. 28, 2017

(54) SYSTEM AND METHOD FOR OPERATING AN AQUEOUS INKJET PRINTER TO COAT MEDIA PRIOR TO PRINTING IMAGES ON THE MEDIA WITH THE AQUEOUS INKJET PRINTER

(71) Applicant: Xerox Corporation, Norwalk, CT (US)

(72) Inventor: Chu-heng Liu, Penfield, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 14/791,819

(22) Filed: Jul. 6, 2015

(65) Prior Publication Data

US 2017/0008311 A1 Jan. 12, 2017

(51) Int. Cl.
*B41J 11/00* (2006.01)

(52) U.S. Cl.
CPC ..... *B41J 11/0015* (2013.01)

(58) Field of Classification Search
CPC ..... B41J 11/0015; B41J 2/0057; G03G 2215/00801
See application file for complete search history.

(56) References Cited

U.S. PATENT DOCUMENTS

| | | | | |
|---|---|---|---|---|
| 4,035,214 | A | 7/1977 | Shuppert et al. | |
| 4,135,960 | A | 1/1979 | Shuppert et al. | |
| 4,673,303 | A | 6/1987 | Sansone et al. | |
| 5,623,296 | A | 4/1997 | Fujino et al. | |
| 5,750,314 | A | 5/1998 | Fromson et al. | |
| 5,966,150 | A * | 10/1999 | Lester | B41J 2/005 347/105 |
| 6,059,407 | A | 5/2000 | Komatsu et al. | |
| 6,335,978 | B1 | 1/2002 | Moscato et al. | |
| 6,357,870 | B1 | 3/2002 | Beach et al. | |
| 6,398,357 | B1 * | 6/2002 | Holloway | C09D 11/322 347/100 |
| 6,709,096 | B1 | 3/2004 | Beach et al. | |
| 6,713,160 | B2 | 3/2004 | Kitamura et al. | |
| 7,281,790 | B2 | 10/2007 | Mouri et al. | |
| 7,686,445 | B2 | 3/2010 | Fioravanti et al. | |
| 7,869,099 | B2 | 1/2011 | Mashtare | |
| 8,011,781 | B2 | 9/2011 | Taniuchi et al. | |
| 8,025,389 | B2 | 9/2011 | Yamanobe et al. | |
| 8,132,885 | B2 | 3/2012 | Ramakrishnan et al. | |
| 2002/0196321 | A1 | 12/2002 | Katsuki | |
| 2007/0285486 | A1 | 12/2007 | Harris et al. | |
| 2008/0032072 | A1 | 2/2008 | Taniuchi et al. | |

(Continued)

FOREIGN PATENT DOCUMENTS

| | | |
|---|---|---|
| EP | 0 583 168 B1 | 10/1998 |
| EP | 1 919 711 B1 | 11/2010 |

(Continued)

*Primary Examiner* — Bradley Thies
(74) *Attorney, Agent, or Firm* — Maginot Moore & Beck LLP

(57) ABSTRACT

An aqueous inkjet printer coats media with a material prior to printing without having to dry the material on the media. The printer includes a coating applicator for applying the material to the surface of a rotating member and a dryer for evaporating water from the material to raise its viscosity to a gel-like state. The coating is transferred to media in a nip formed between the rotating member and a roller.

15 Claims, 3 Drawing Sheets

(56) References Cited

U.S. PATENT DOCUMENTS

| | | | | |
|---|---|---|---|---|
| 2009/0080949 | A1* | 3/2009 | Yamanobe | B41J 2/01 399/308 |
| 2011/0234729 | A1 | 9/2011 | Noguchi | |
| 2012/0013694 | A1 | 1/2012 | Kanke | |
| 2013/0127965 | A1 | 5/2013 | Kushida et al. | |
| 2013/0127966 | A1 | 5/2013 | Noguchi et al. | |
| 2014/0087295 | A1* | 3/2014 | Gila | B41J 2/0057 430/32 |
| 2015/0085039 | A1* | 3/2015 | Liu | C09D 11/38 347/102 |

FOREIGN PATENT DOCUMENTS

| | | | |
|---|---|---|---|
| JP | 2767796 | B2 | 6/1998 |
| JP | 3169634 | A | 5/2001 |
| JP | 2001-212956 | A | 8/2001 |
| JP | 4006374 | B2 | 11/2001 |
| JP | 2002-138228 | A | 5/2002 |
| JP | 3379558 | B2 | 2/2003 |
| WO | 93/17000 | A1 | 4/1993 |
| WO | 2011-014185 | A1 | 2/2011 |

* cited by examiner

SYSTEM AND METHOD FOR OPERATING AN AQUEOUS INKJET PRINTER TO COAT MEDIA PRIOR TO PRINTING IMAGES ON THE MEDIA WITH THE AQUEOUS INKJET PRINTER

TECHNICAL FIELD

This disclosure relates generally to aqueous inkjet printing, and, in particular, to media preparation during the aqueous ink printing process.

BACKGROUND

In general, inkjet printing machines or printers include at least one printhead that ejects drops or jets of liquid ink onto a recording or image forming surface. An aqueous inkjet printer employs water-based or solvent-based inks in which pigments or other colorants are suspended or in solution. Once the aqueous ink is ejected onto an image receiving surface by a printhead, the water or solvent is evaporated to stabilize the ink image on the image receiving surface.

When aqueous ink is ejected directly onto media, the aqueous ink tends to soak into the media when it is porous, such as paper, and change the physical properties of the media. Because the spread of the ink droplets striking the media is a function of the media surface properties and porosity, the print quality will be inconsistent. To address this issue, coating systems have been developed that apply a coating to the media prior to the media being directly printed. While these coatings help make the media more water resistant without adversely impacting the ability of the media to hold the aqueous ink, they do have drawbacks. Because the coatings are applied at a low viscosity state, they contain a significant amount of water. In order to enable the media to regain its properties for printing, the water in the coating needs to be dried before the printing commences. This drying requires large dryers that generate intense heat and consume significant amounts of energy. Preparation of media with coatings appropriate for aqueous ink printing without consuming large quantities of energy to dry the coatings would be beneficial.

SUMMARY

An aqueous inkjet printer has been configured with a media coating system that does not require water to be dried from the media after the coating is applied to the media. The printer includes a rotating member, a coating applicator configured to apply a material to a surface of the rotating member, a dryer configured to at least partially dry the material applied to the surface of the rotating member and produce a tacky coating of the material on the surface of the rotating member, and a transfer roller configured to form a nip with the rotating member to enable the at least partially dried material on the surface of the rotating member to transfer to media passing through the nip, and at least one printhead configured to eject aqueous ink onto the material transferred to the media as the media passes the at least one printhead.

A method of operating an aqueous inkjet printer does not require water to dry from media after a coating has been applied to the media. The method includes applying a material with a coating applicator to a surface of a rotating intermediate member, directing heated air towards the material on the surface of the rotating intermediate member to evaporate water and raise a viscosity of the material to a tacky state to form a coating on the rotating intermediate member, transferring the coating onto a media sheet moving through a nip formed with the rotating intermediate member and a roller, and ejecting ink onto the coating to form an ink image on the coating.

DETAILED DESCRIPTION

Figure 1:
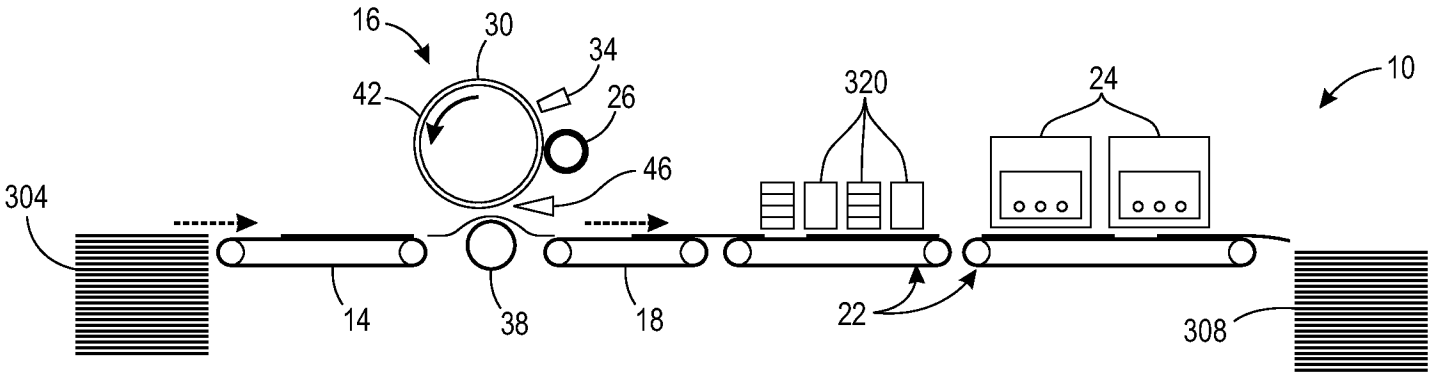
FIG. 1 is a schematic drawing of an aqueous inkjet printer that indirectly applies a media coating for aqueous ink printing to the media.

For a general understanding of the present embodiments, reference is made to the drawings. In the drawings, like reference numerals have been used throughout to designate like elements. As used herein, the terms "printer," "printing device," or "imaging device" generally refer to a device that produces an image on print media with aqueous ink and may encompass any such apparatus, such as a digital copier, bookmaking machine, facsimile machine, multi-function machine, or the like, which generates printed images for any purpose. Image data generally include information in electronic form which are rendered and used to operate the inkjet ejectors to form an ink image on the print media. These data can include text, graphics, pictures, and the like. The operation of producing images with colorants on print media, for example, graphics, text, photographs, and the like, is generally referred to herein as printing or marking. Aqueous inkjet printers use inks that have a high percentage of water or solvent relative to the amount of colorant in the ink.

The term "printhead" as used herein refers to a component in the printer that is configured with inkjet ejectors to eject ink drops onto an image receiving surface. A typical printhead includes a plurality of inkjet ejectors that eject ink drops of one or more ink colors onto the image receiving surface in response to firing signals that operate actuators in the inkjet ejectors. The inkjets are arranged in an array of one or more rows and columns. In some embodiments, the inkjets are arranged in staggered diagonal rows across a face of the printhead. Various printer embodiments include one or more printheads that form ink images on an image receiving surface. Some printer embodiments include a plurality of printheads arranged in a print zone. An image receiving surface, such as an intermediate imaging surface, moves past the printheads in a process direction through the print zone. The inkjets in the printheads eject ink drops in rows in a cross-process direction, which is perpendicular to the process direction across the image receiving surface. As used in this document, the term "aqueous ink" includes liquid inks in which colorant is in solution with water or one or more solvents.

Figure 3:
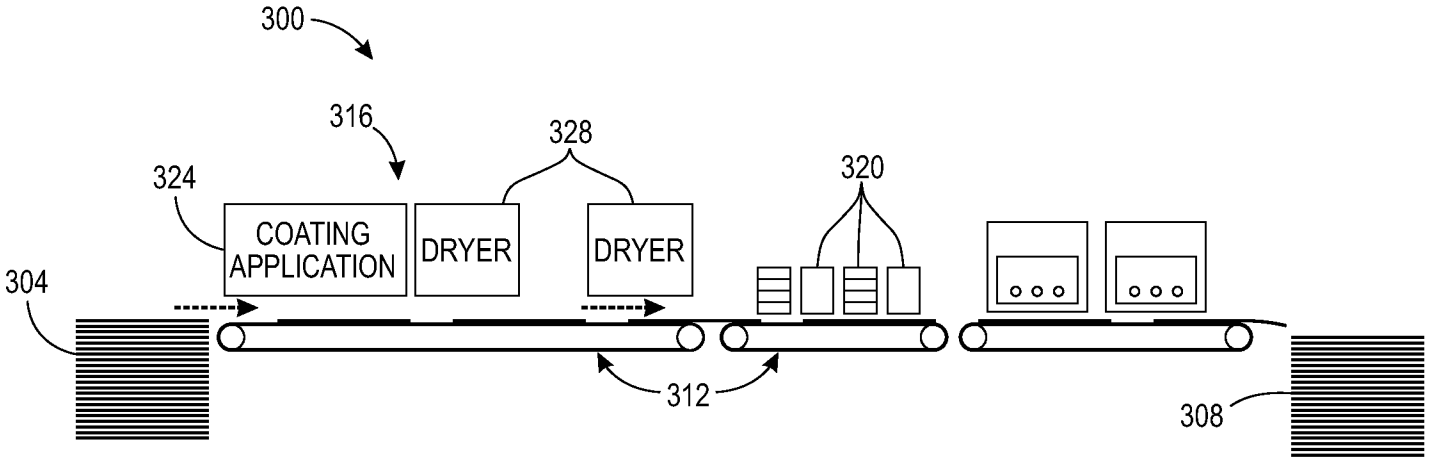
FIG. 3 PRIOR ART
FIG. 3 is a schematic drawing of a prior art aqueous inkjet printer that applies a media coating for aqueous ink printing directly to the media.

FIG. 3 depicts a prior art aqueous ink printing system. The system 300 includes a media supply 304, a media receptacle 308, and a media transport 312 that moves media sheets from the media supply past a media coating subsystem 316 and one or more printheads 320 to the media receptacle. The media coating subsystem 316 includes a coating applicator 324 and one or more dryers 328. The coating applicator 324 is in fluidic communication with a source of media coating (not shown) and applies the coating directly to the media sheets as they pass the applicator. The dryers 328 direct heated air towards the coated media to heat the coating and evaporate water from the coating. After the coated media exits the dryers, the sheets pass the printheads for the printing of an ink image on the coated media sheets. The sheets are then deposited in the media receptacle 308 for later collection. As previously noted, this type of system consumes significant amounts of energy.

FIG. 1 illustrates a high-speed aqueous ink image producing machine or printer 10 that coats media without using larger dryers to evaporate water from the coating on the media. Using like reference numbers for like components, the system 10 includes a media supply 304, a media receptacle 308, a media transport 14, 18, and 22 that moves media sheets from the media supply past a media coating subsystem 16, one or more printheads 320, and ink dryers 24 to the media receptacle. The media coating subsystem 16 includes a coating applicator 26, a rotating intermediate member 30, a coating dryer 34, and a transfer roller 38. The coating applicator 26 is in fluidic communication with a source of media coating (not shown) and applies the coating to the rotating intermediate member as the member rotates past the applicator. The applicator 26 can be a roller that contacts the rotating intermediate member to apply the coating material or it can be a head configured with apertures to enable a spray of the coating material to be directed towards the surface of the intermediate member. The dryer 34 directs heated air towards the coated member 30 to heat the coating and evaporate water from the coating. The transfer roller 38 forms a nip with the rotating member 30. As the coated member enters the nip, the pressure within the nip transfers the coating from the intermediate member 30 to the media sheets. The coated sheets then pass the printheads for the printing of an ink image and then the aqueous ink on the media sheets is dried by the dryers 24 before the sheets are deposited in the media receptacle 308 for later collection.

The intermediate rotating member 30 is shown in FIG. 1 in the form of a rotating drum, but can also be configured as a rotating endless belt. The intermediate rotating member 30 has an outer blanket 42 mounted about the circumference of the member 30. The blanket moves with the member as the member rotates. The blanket is formed of a material having a relatively low surface energy to facilitate transfer of the coating from the surface of the blanket 42 to the media sheet in the nip formed with the transfer roller 38. As used in this document, the term "blanket" refers to a layer of material mounted to the intermediate rotating member to cover a circumferential surface of the member. Such materials include silicones, fluro-silicones, synthetic rubber and fluoropolymer elastomer, such as Viton®, and the like. A surface maintenance unit (SMU) 46 removes residual coating left on the surface of the blanket 42 after the coating has been transferred to a media sheet. Coatings used in the subsystem 16 can be composed of binders, surfactants, humectants, and water. The coating material is applied to the surface of the blanket 42 to form a thin layer on the blanket surface. Although the rotating intermediate member 30 is described as having a blanket 42 mounted about the member, other configurations of the intermediate member can be used. For example, the intermediate rotating member can have a surface integrated into its circumference that enables a coating layer to be formed on the surface. As used in this document, the term "rotating intermediate member" includes these various configurations.

The coating dryer 34 includes a heater, such as a radiant infrared, radiant near infrared or a forced hot air convection heater, and a heated air source. In one embodiment, an infrared heater applies infrared heat to the coating on the surface of the blanket 42 to evaporate water in the coating, while a heated air source directs heated air over the coating to supplement the evaporation of the water from the coating. The heat and air flow produced by the dryer 34 is sufficient to alter the viscosity of the coating from a liquid to a sticky paste or a gel. The composition can be heated to a temperature in the range of about 80 degress C to about 200 degrees C. to accelerate the removal of water. In one embodiment, the viscosity of the material when applied to the rotating member is about 100 centipoise and when it is partially dried its viscosity is about 50,000 centipoise. This alteration helps the coating transfer to the media in the nip to be very efficient.

The high efficiency transfer of the coating to the media is typically greater than 90% and the coating separates smoothly from the intermediate member to produce a glossy coating on the substrate, which is important for the inkjet printing performance. A conventional transfer of viscous liquids splits the material at the interfaces, which typically occurs in areas in which about 50% of the coating material stays on the carrier surface and about 50% of the coating material is transferred to the media. In addition, the surface of the transferred coating is rough due to the splitting of the film. This low efficiency transfer and the surface roughness are not conducive for high image quality.

In an embodiment, the high efficiency transfer is enabled by the low surface energy of the intermediate member, optimized coating composition, and optimized coating drying. The surface of the intermediate member can comprise silicones, hydrofluoroelastomers, and hybrids and blends of silicone and hydrofluoroelastomers. Coating formulations used may be composed of binders, surfactants, humectants and water. The binders can include, for example, water soluble polymers, such as starch and polyvinyl alcohol (PVOH), or latex binders, such as polyvinyl acetate. Evaporating a portion of the water in the coating material enables the binder to make the coating sufficiently sticky and cohesive to enable a high efficiency transfer of the coating to the media in the nip. The humectant helps prevent the coating from becoming too dry for good transfer. Examples of humectants include glycerol and various glycols, such as ethylene glycol or propylene glycol. Furthermore, the humectant in the coating can significantly improve the ink spreading during the subsequent inkjet ejection portion of the print cycle.

Figure 2:
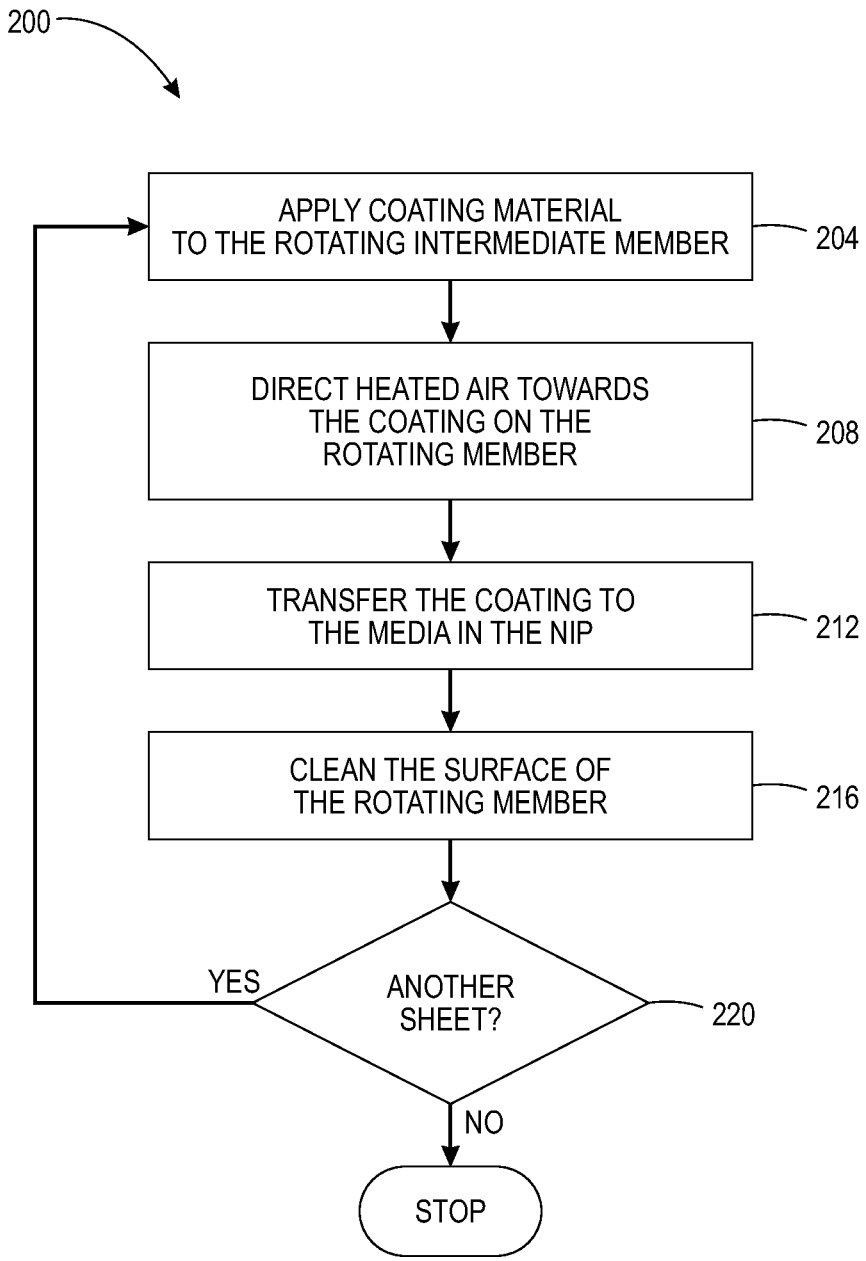
FIG. 2 is a flow diagram of a process for operating the printer of FIG. 1.

A process for operating the printer of FIG. 1 is illustrated in FIG. 2. That process 200 begins with the application of a media coating material with the coating applicator to the rotating intermediate member (block 204). A heated source of air is directed towards the coating on the member to evaporate water and raise the viscosity of the coating to a highly sticky and cohesive or gel-like state (block 208). The intermediate member rotates into the nip formed by the member and the transfer roller to transfer the coating to a media sheet moving through the nip (block 212). The surface of the intermediate member exiting the nip is cleaned by the SMU for the next coating cycle, while the media sheet continues to the printheads for printing (block 216). If another sheet is to be processed (block 220), the coating cycle is repeated (block 204). Otherwise, the process terminates.

It will be appreciated that variations of the above-disclosed apparatus and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

What is claimed is:

1. A printer comprising:

a rotating member having a low energy surface;

a coating applicator configured to contact the low energy surface of the rotating member to apply a coating material having a humectant and water directly to the low energy surface of the rotating member;

a dryer having a heater and a heated air source, the heater being configured to evaporate a portion of the water from the coating material and the heated air source being configured to direct heated air over the coating material on the low energy surface to supplement evaporation of the water from the coating material on the low energy surface to at least partially dry the coating material applied to the low energy surface of the rotating member and produce a tacky coating of the coating material on the low energy surface of the rotating member;

a transfer roller configured to form a nip with the rotating member to enable the at least partially dried material on the surface of the rotating member to transfer to media passing through the nip; and at least one printhead configured to eject aqueous ink onto the material transferred to the media as the media passes the at least one printhead.

2. The printer of claim 1 wherein the rotating member is a rotating drum.

3. The printer of claim 1 wherein the rotating member is a rotating endless belt.

4. The printer of claim 1, the rotating member further comprising:

a blanket mounted to a circumferential surface of the rotating member.

5. The printer of claim 4, the blanket consisting essentially of one of silicones, fluro-silicones, synthetic rubber with fluoropolymer elastomer, hydrofluoroelastomers, and hybrids and blends of silicone and hydrofluoroelastomers.

6. The printer of claim 1, the heater being one of a radiant infrared heater, a radiant near infrared heater, and a forced hot air convection heater.

7. The printer of claim 1, the coating applicator further comprising:

a roller that contacts a supply of the coating material to enable the roller to contact directly the coating material in the supply and directly transfer the coating material to the low energy surface of the rotating member.

8. The printer of claim 1 wherein the coating material includes a binder consisting essentially of a water soluble polymer, polyvinyl alcohol, or latex.

9. The printer of claim 1 wherein the coating material includes glycerol, ethylene glycol, or propylene glycol as the humectant.

10. A method of operating an aqueous ink printer comprising:

contacting a low energy surface of a rotating intermediate member with a coating applicator to apply a coating material having a humectant and water directly to the low energy surface of the rotating intermediate member;

operating a dryer having a heater and a heated air source, the heater being operated to evaporate water from the coating material on the low energy surface of the rotating intermediate member and the heated air source being operated to direct heated air towards the coating material on the low energy surface of the rotating intermediate member to supplement evaporation of water from the coating material on the low energy of the rotating intermediate member and raise a viscosity of the coating material to a tacky state on the rotating intermediate member;

transferring the coating material from the rotating intermediate member onto a media sheet moving through a nip formed with the rotating intermediate member and a roller; and ejecting ink onto the coating material transferred to the media sheet to form an ink image on the coating material on the media sheet.

11. The method of claim 10 further comprising:

removing the coating material remaining on a portion of the low energy surface of the rotating intermediate member after the portion of the rotating intermediate member has passed through the nip.

12. The method of claim 10, the operation of the heater further comprising:

directing heated air towards the low energy surface of the rotating intermediate member with one of a radiant infrared heater, a radiant near infrared heater, and a forced hot air convection heater.

13. The method of claim 10, the application of the coating material further comprising:

applying a composition that also includes a binder to the low energy surface of the rotating intermediate member.

14. The method of claim 13 wherein the application of the composition includes applying water soluble polymers, polyvinyl alcohol, or latex as the binder in the composition.

15. The method of claim 13 wherein the application of the composition includes applying glycerol, ethylene glycol, or propylene glycol as the humectant in the composition.

* * * * *